US011324264B2

(12) United States Patent
Chatzidakis

(10) Patent No.: US 11,324,264 B2
(45) Date of Patent: May 10, 2022

(54) FACIAL MASK WITH EXPANDABLE RIB STRUCTURES

(71) Applicant: Pantelis Chatzidakis, Whitestone, NY (US)

(72) Inventor: Pantelis Chatzidakis, Whitestone, NY (US)

( * ) Notice: Subject to any disclaimer, the term of this patent is extended or adjusted under 35 U.S.C. 154(b) by 0 days.

(21) Appl. No.: 17/245,917

(22) Filed: Apr. 30, 2021

(65) Prior Publication Data

US 2021/0345698 A1 Nov. 11, 2021

Related U.S. Application Data

(60) Provisional application No. 63/036,598, filed on Jun. 9, 2020, provisional application No. 63/022,813, filed on May 11, 2020.

(51) Int. Cl.
*A41D 13/11* (2006.01)

(52) U.S. Cl.
CPC ..... *A41D 13/1107* (2013.01)

(58) Field of Classification Search
CPC ..... A41D 13/1107; A41D 13/1218; A41D 13/1153; A62B 18/025; A62B 23/025
USPC ..... 2/6.4, 6.5, 9, 10, 173, 206, 424; 128/206.15, 207.12, 201.24, 857, 858
See application file for complete search history.

(56) References Cited

U.S. PATENT DOCUMENTS 4,291,417 A * 9/1981 Pagano ..... A42B 1/201 2/202
5,116,288 A * 5/1992 Kondo ..... A45B 23/00 135/135
5,896,590 A * 4/1999 Fleisch ..... A42B 3/322 2/455
11,006,681 B1 * 5/2021 Campos ..... A41D 13/1153
2005/0241648 A1 * 11/2005 Dobbs ..... A61G 1/04 128/857
2013/0305431 A1 * 11/2013 Mraz ..... A42B 1/0181 2/173

OTHER PUBLICATIONS

International Search Report and Written Opinion dated Jul. 9, 2021 for corresponding International PCT Application No. PCT/US2021/031697.

* cited by examiner

*Primary Examiner* — Katherine M Moran
(74) *Attorney, Agent, or Firm* — Carter, DeLuca & Farrell LLP; George Likourezos; Bret P. Shapiro

(57) ABSTRACT

Apparatus to limit exposure to pathogens. The apparatus includes two hinges connected by a hinge connector, a plurality of ribs, and mask material. The plurality of ribs includes at least a base rib and a top rib. A first end of each rib is connected to a first hinge of the two hinges and a second end of each rib is connected to a second hinge of the two hinges. The two hinges are configured to position and secure the top rib at multiple positions and configurations. The ribs are attached to the mask material.

16 Claims, 6 Drawing Sheets

FACIAL MASK WITH EXPANDABLE RIB STRUCTURES

CROSS REFERENCE TO RELATED APPLICATIONS

This application claims priority to provisional application 63/022,813 filed May 11, 2020 and provisional application 63/036,598 filed Jun. 9, 2020, the entirety of which are hereby incorporated by reference.

TECHNICAL FIELD

The present disclosure generally relates to face masks, and more particularly, to face masks configured to limit a wearer's exposure to pathogens.

BACKGROUND

Unless otherwise indicated herein, the materials described in this section are not prior art to the claims in this application and are not admitted being prior art by inclusion in this section.

Face masks may be an effective weapon to fend off contagious pathogens, including viruses that cause respiratory tract infections. Face masks may prevent transmission of contagious pathogens that cause respiratory distress by blocking such contagious pathogens from entering the nose and mouth of a face mask wearer. Face masks may also prevent a wearer that is infected from spreading contagious pathogens to the surrounding area and to others. Face masks may be uncomfortable to wear for long periods of time due to limitations in their design, including poor fit in the nose region, poor fit over the ears, pinching, eyeglasses fogging, speech distortion, hypoxia, and hypoxia related fatigue.

SUMMARY

Existing challenges associated with the foregoing, as well as other challenges, are overcome by the presently disclosed face mask with expandable rib structures.

One embodiment of the present disclosure is an apparatus to limit exposure to pathogens. The apparatus includes two hinges connected by a hinge connector, a plurality of ribs, and mask material. The plurality of ribs includes at least a base rib and a top rib. A first end of each rib is connected to a first hinge of the two hinges. A second end of each rib is connected to a second hinge of the two hinges. The two hinges are configured to position and secure the top rib at multiple positions and configurations. The ribs are attached to the mask material.

In aspects, the multiple positions and configurations the hinges are configured to position and secure the ribs at include expanded positions with a center of each rib positioned away from a center of each other rib and a contracted position with centers of the ribs aligned and in contact with each other.

In aspects, the hinges are further configured to lock the ribs in the multiple positions and configurations.

In aspects, the hinges generate a clicking sound when a rib is locked in a position.

In aspects, the hinges generate a tactile vibration when a rib is locked in a position.

In aspects, the base rib is configured to rest upon a chest of a user and provide a base support to the apparatus.

In aspects, the top rib is configured to conform to a nose and face of a user when the top rib is positioned upon the nose and face of the user.

In aspects, the mask material includes at least one of tightly woven fabrics, cotton, cotton blends, synthetic fabrics, breathable fabrics, filter material, HEPA filter material, and N95 filters.

In aspects, the plurality of ribs further includes at least one intermediary rib between the base rib and the top rib.

In aspects, the at least one intermediary rib provides support to the mask material.

In aspects, the plurality of ribs is constructed from wood, plastic, bamboo, or metal.

Another embodiment of the present disclosure includes an apparatus to limit exposure to pathogens. The apparatus includes two hinges connected by a hinge connector, a base rib, a top rib, an intermediary rib, and mask material. A first end of the base rib is connected to a first hinge of the two hinges and a second end of the base rib is connected to a second hinge of the two hinges. A first end of the top rib is connected to the first hinge of the two hinges and a second end of the top rib is connected to the second hinge of the two hinges. A first end of the intermediary rib is connected to the first hinge of the two hinges and a second end of the intermediary rib is connected to the second hinge of the two hinges. The two hinges are configured to position and secure the top rib and intermediary rib at multiple positions and configurations, and the top rib and bottom rib are attached to the mask material.

In aspects, the multiple positions and configurations the hinges are configured to position and secure the top rib and intermediary rib at include expanded positions with a center of each of the top rib, bottom rib, and intermediary rib positioned away from each other and a contracted position with centers of each of the top rib, bottom rib, and intermediary rib aligned and in contact with each other.

In aspects, the hinges are further configured to lock the top rib and intermediary rib in the multiple positions and configurations.

In aspects, the hinges generate a clicking sound when any of the top rib and intermediary rib is locked in a position.

In aspects, the hinges generate a tactile vibration when any of the top rib and intermediary rib is locked in a position.

Another embodiment of the present disclosure is an apparatus to limit exposure to pathogens. The apparatus includes two hinges connected by a hinge connector, a base rib, a top rib, an intermediary rib, and mask material. The base rib is configured to rest upon a chest of a user and provide a base support to the apparatus. A first end of the base rib is connected to a first hinge of the two hinges and a second end of the base rib is connected to a second hinge of the two hinges. The top rib is configured to conform to a nose and face of the user when the top rib is positioned upon the nose and face of the user. A first end of the top rib is connected to the first hinge of the two hinges and a second end of the top rib is connected to the second hinge of the two hinges. The intermediary rib is between the base rib and the top rib. A first end of the intermediary rib is connected to the first hinge of the two hinges and a second end of the intermediary rib is connected to the second hinge of the two hinges. The mask material includes at least one of tightly woven fabrics, cotton, cotton blends, synthetic fabrics, breathable fabrics, filter material, HEPA filter material, and N95 filters. The two hinges are configured to position, secure, and lock the top rib and intermediary rib at multiple positions and configurations. The hinges generate a clicking sound and a tactile vibration when any of the top rib and intermediary rib is locked in a position. The top rib and bottom rib are attached to the mask material.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE FIGURES

The foregoing and other features of this disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings, in which:

DETAILED DESCRIPTION

Figure 1:
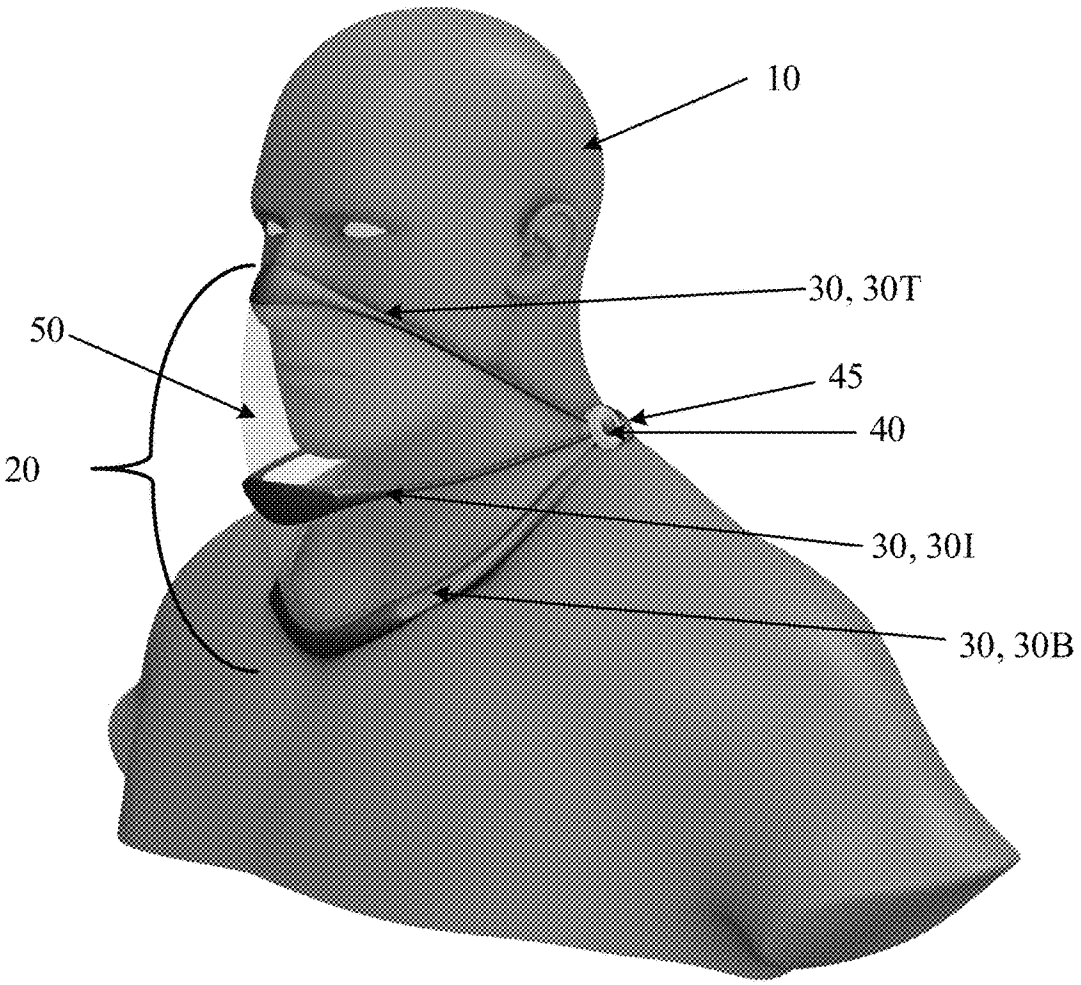
FIG. 1 is a side perspective view of an expanded face mask with expandable rib structures on a wearer.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the Figures, can be arranged, substituted, combined, separated, and designed in a wide variety of different configurations, all of which are explicitly contemplated herein.

FIG. 1 is a side perspective view of an expanded face mask with expandable rib structures on a wearer, arranged in accordance with at least some embodiments described herein. A user 10 may wear a face mask with expandable rib structure 20 in an expanded position. Face mask with expandable rib structure 20 may include ribs 30, two hinges 40, hinge connector 45, and mask material 50. Face mask with expandable rib structure 20 may be worn by user 10 with hinge connector 45 across a back of user 10 neck and ribs 30 upon chest when face mask with expandable rib structure 20 is not expanded or in front of user 10 chest, neck, and face when face mask when expandable rib structure 20 is expanded.

Ribs 30 may include a base rib 30B and a top rib 30T. Ribs 30 may further include one or more intermediary ribs 301. Ribs 30 may essentially be horizontal when face mask with expandable rib structure 20 is worn by user 10. A first end of each rib 30 may be connected to a first hinge 40 and a second end of each rib 30 may be connected to a second hinge 40. First and second hinges 40 may be connected by hinge connector 45. Base rib 30B may be fixedly attached to hinges 40. Hinges 40 may be configured to position and secure top rib 30T and intermediary ribs 301 at multiple positions and configurations along a circumference of hinges 40 including expanded positions with a center of each rib 30 positioned away from a center of each other rib 30 and a contracted position with centers of ribs 30 aligned and in contact with each other. Hinges 40 may be configured to lock a position of each rib 30 at intervals along a circumference of hinges 40. Hinges 40 may generate a clicking sound when a rib 30 is positioned and locked at an interval along the circumference of hinges 40. Hinges 40 may generate a tactile vibration when a rib 30 is positioned and locked at an interval along a range of hinges 40. Lockable positions for ribs 30 along hinges 40 may include intervals for positioning top rib 30T upon a nose of user 10.

Top rib 30T and base rib 30B may be attached to or embedded within mask material 50. Intermediate ribs 301 may be attached to mask material 50 or may support mask material 50. Mask material 50 may expand or unfold when ribs 30 are expanded and may fold or compress when ribs 30 are contracted. Mask material 50 may prevent pathogens including viruses, bacterial, mold, dust particles, microfibers, etc. from passing through mask material 50. Mask material 50 may include tightly woven fabrics, cotton, cotton blends, synthetic fabrics, breathable fabrics, polypropylene, filter material, HEPA filter material, N95 filters, etc. Mask material 50 may be a single layer or multiple layers. In an example, mask material may be multiple layers and may include an inner layer of absorbent material, such as cotton, a middle layer of non-woven non-absorbent material, such as polypropylene, and an outer layer of non-absorbent material, such as polyester or polyester blend.

Base rib 30B may be configured to rest upon a chest of user 10 and provide a base support to face mask with expandable rib structure 20. Top rib 30T may be configured to conform to a nose and face of user 10 when positioned upon the nose and face of user 10. Top rib 30T may be configured to flex towards user 10 face to ensure mask material 50 covers the face and prevents pathogens from reaching user 10 face along the edges of mask material 50. Top rib 30T may be configured to provide a snug fit without gaps for face mask with expandable rib structure 20 to face of user 10 and may inhibit air from leaking out of face mask with expandable rib structure 20 where top rib 30T is in contact with face of user 10. One or more intermediary ribs 301 may be positioned between base rib 30B and top rib 30T and may provide support to mask material 50 between base rib 30B and top rib 30T. Ribs 30 may be constructed from wood, plastic, bamboo, metal, or other materials.

Figure 2:
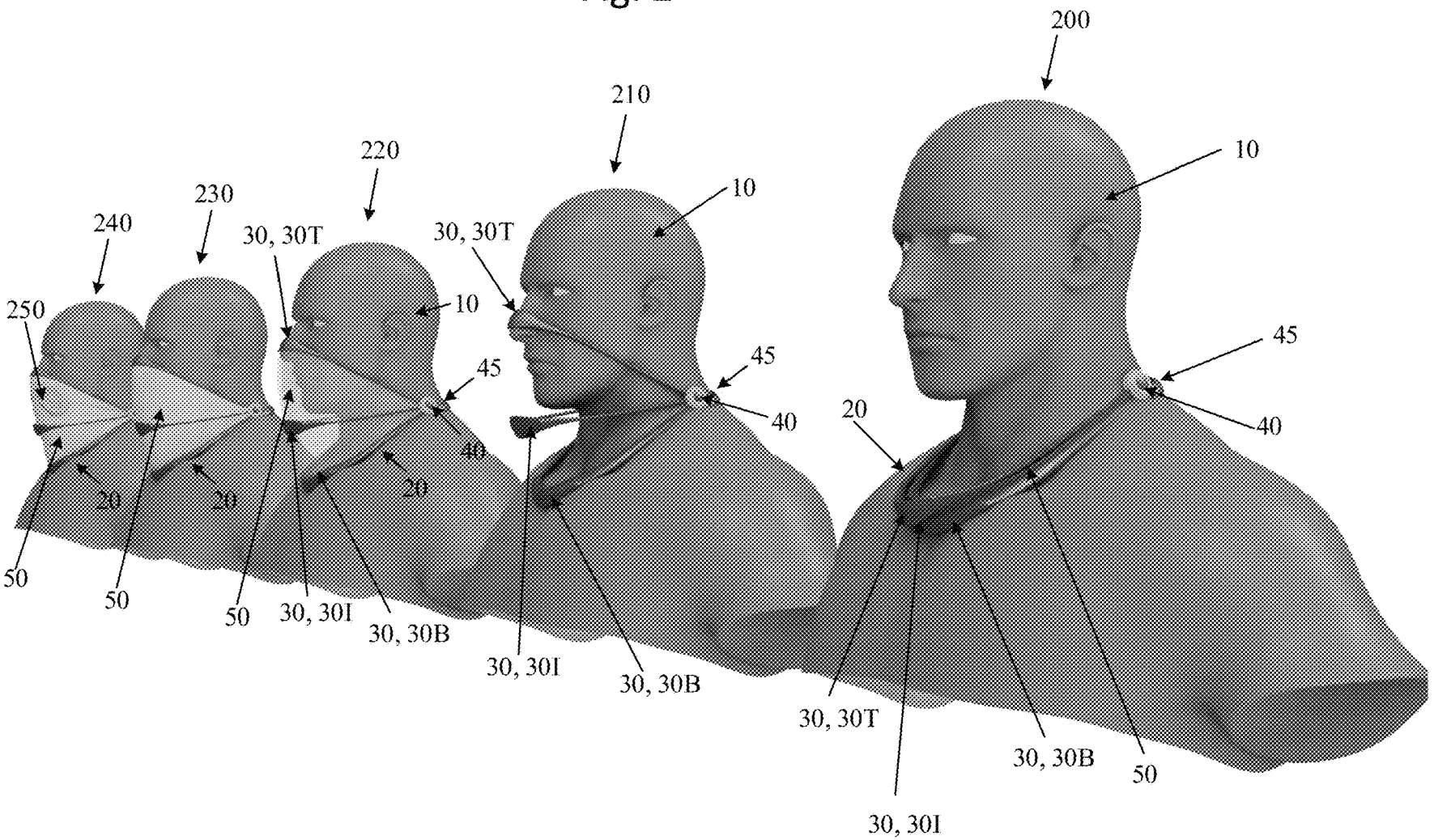
FIG. 2 is a side perspective view of several configurations of a face mask with expandable ribs.

FIG. 2 is a side perspective view of several configurations of a face mask with expandable ribs, arranged in accordance with at least some embodiments described herein. Those components in FIG. 2 that are labeled identically to components of FIG. 1 will not be described again for the purposes of brevity.

At 200, face mask with expandable rib structure 20 is shown resting upon a chest of user 10 with ribs 30 contracted together in a contracted position. Face mask with expandable rib structure 20 in a contracted position may resemble a necklace when resting on a chest of user 10. Top rib 30T, intermediary rib/ribs 301, and base rib 30B may be configured to align to each other when contracted together in a contracted position. Mask material 50 may fold or compress between ribs 30 when ribs 30 are contracted together in a contracted position.

At 210, ribs 30 connected to hinges 40 and hinge connector 45 are shown. Base rib 30B is shown positioned upon a chest of user 10. Base rib 30B may rest upon chest of user 10 and provide a base to support hinges 40 and other ribs 30. Hinge support 45 may rest upon neck of user 10 and work in conjunction with base rib 30B to provide support to hinges 40 and other ribs 30. Top rib 30T may be configured to move along hinges 40 and be positioned upon a nose of user 10. Top rib 30T may be configured to conform to nose and face of user 10 when positioned upon nose and face of user. One or more intermediary ribs 301 may be positioned between base rib 30B and top rib 30T when locked in place by hinges 40.

At 220, face mask with expandable rib structure 20 is shown with mask material 50 translucent so that support structure provided by ribs 30 is visible. As shown at 220, when ribs 30 are expanded along hinges 40, ribs 30 may extend out from hinges 40 and provide a frame to support mask material 50. Ribs 30 may extend out from hinges 40 to provide a frame so that mask material 50 is supported away from face of user 10 and does not contact face of user 10 except at top rib 30T. User 10 may expand face mask with expandable rib structure 20 from contracted position shown at 200 to expanded position shown at 220 by positioning top rib 30T upon nose of user 10 while keeping base rib 30B positioned on chest of user 10.

At 230, face mask with expandable rib structure 20 is shown with opaque mask material 50 expanded. At 240, face mask with expandable rib structure 20 is shown in an embodiment with mask material 50 that includes a HEPA filter or N95 filter 250.

Figure 3:
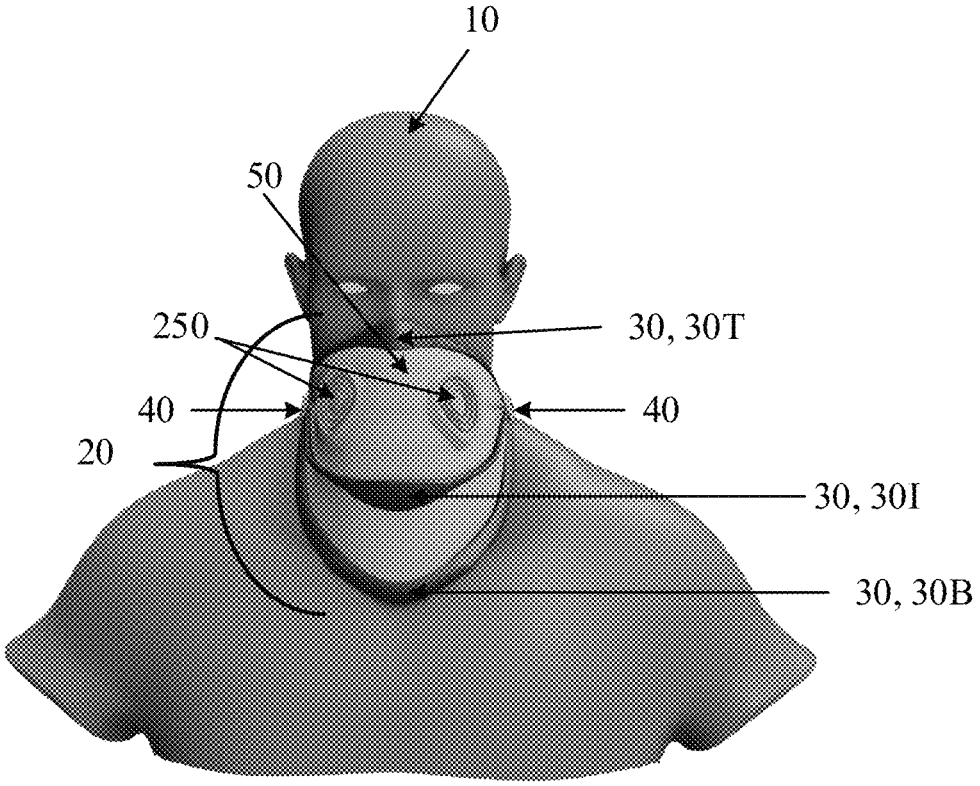
FIG. 3 is a front perspective view of a face mask with expandable ribs.

FIG. 3 is a front perspective view of a face mask with expandable ribs, arranged in accordance with at least some embodiments described herein. Those components in FIG. 3 that are labeled identically to components of FIGS. 1-2 will not be described again for the purposes of brevity.

As shown in FIG. 3, mask with expandable ribs 20 is in an expanded position with top rib 30T upon a nose of user 10. Ribs 30 may extend out from hinges 40 and provide a frame to support mask material 50. Ribs 30T, 301, and 30B may extend out from hinges 40 to provide a frame for mask material 50 so that mask material 50 is supported away from face of user 10. Mask with expandable ribs 20 may not contact a face of user 10 except at top rib 30T.

Figure 4A:
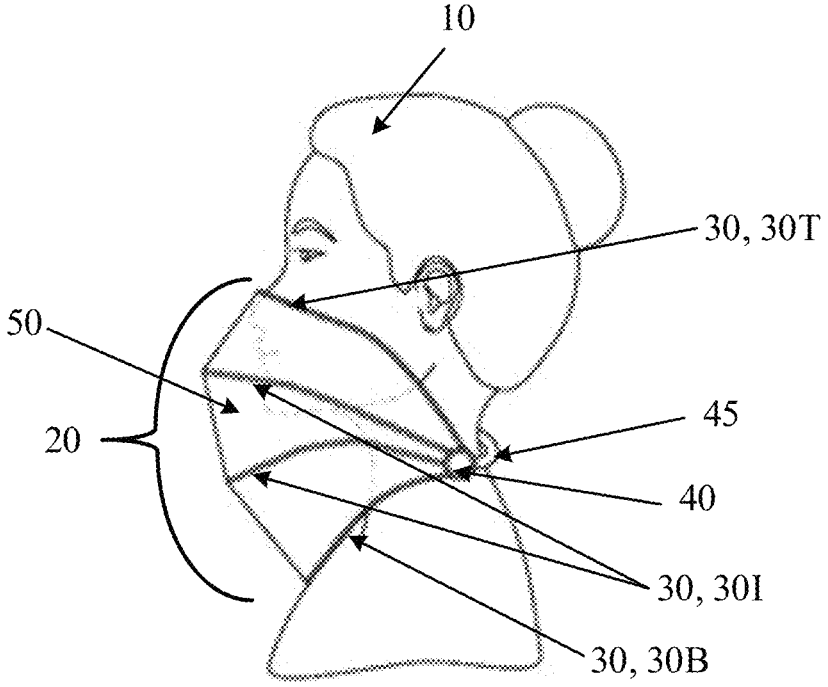
FIG. 4A is a side perspective view of a face mask with expandable ribs.
Figure 4B:
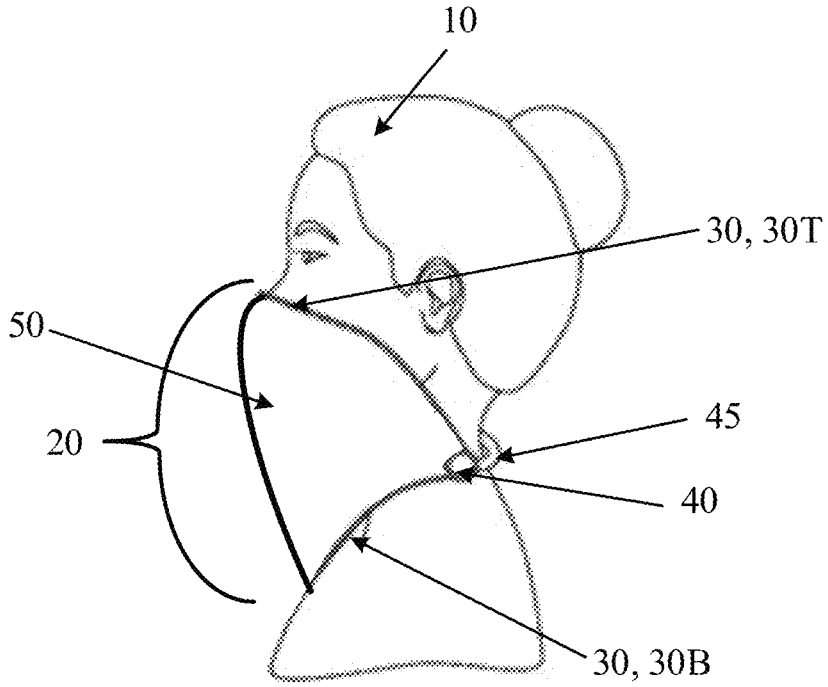
FIG. 4B is a side perspective view of a face mask with expandable ribs.

FIG. 4A is a side perspective view of a face mask with expandable ribs and FIG. 4B is a side perspective view of a face mask with expandable ribs, both arranged in accordance with at least some embodiments described herein. Those components in FIG. 4A and FIG. 4B that are labeled identically to components of FIGS. 1-3 will not be described again for the purposes of brevity.

As shown in FIG. 4A, in an embodiment, mask with expandable ribs 20 may include two intermediary ribs 301 between top rib 30T and base rib 30B. Intermediary ribs 301 may be evenly spaced from each other and from top rib 30T or base rib 30B when mask with expandable ribs 20 is in an expanded position with top rib 30T upon a nose of user 10. Intermediary ribs 30I may extend out from hinges 40 and along with base rib 30B and top rib 30T provide a frame to support mask material 50 so that mask material 50 is supported away from the face of user 10. Mask with expandable ribs 20 may not contact the face of user 10 except at top rib 30T.

As shown in FIG. 4B, in an embodiment, mask with expandable ribs 20 may include top rib 30T and base rib 30B. Top rib 30T and base rib 30B may provide a support to mask material 50 so that mask material 50 is supported away from the face of user 10. Mask with expandable ribs 20 may not contact the face of user 10 except at top rib 30T.

Figure 5A:
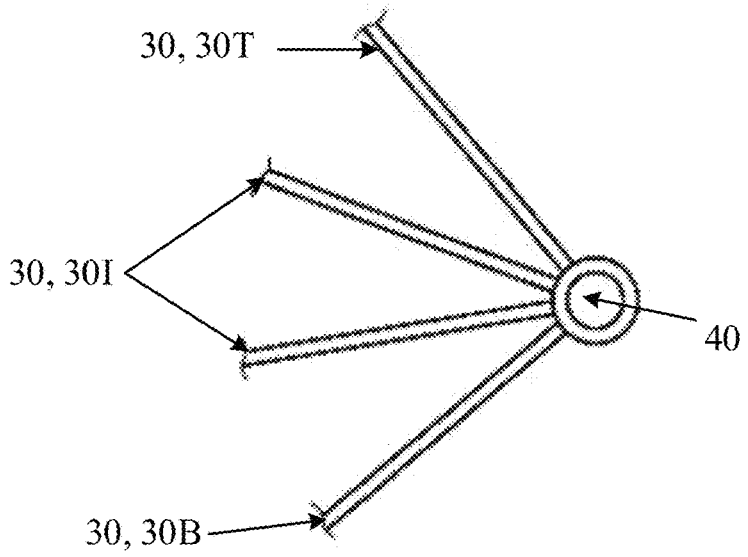
FIG. 5A is a side perspective view of a hinge with ribs in an extended position.
Figure 5B:
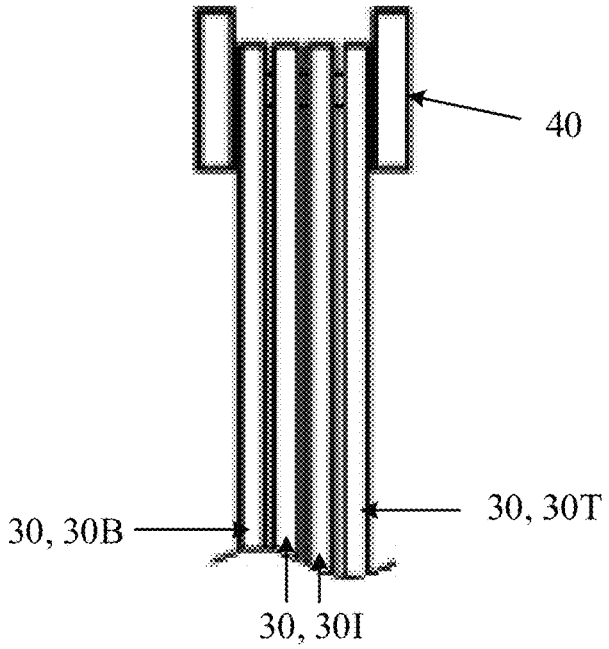
FIG. 5B is a top perspective view of a hinge with ribs in a contracted position.
Figure 5C:
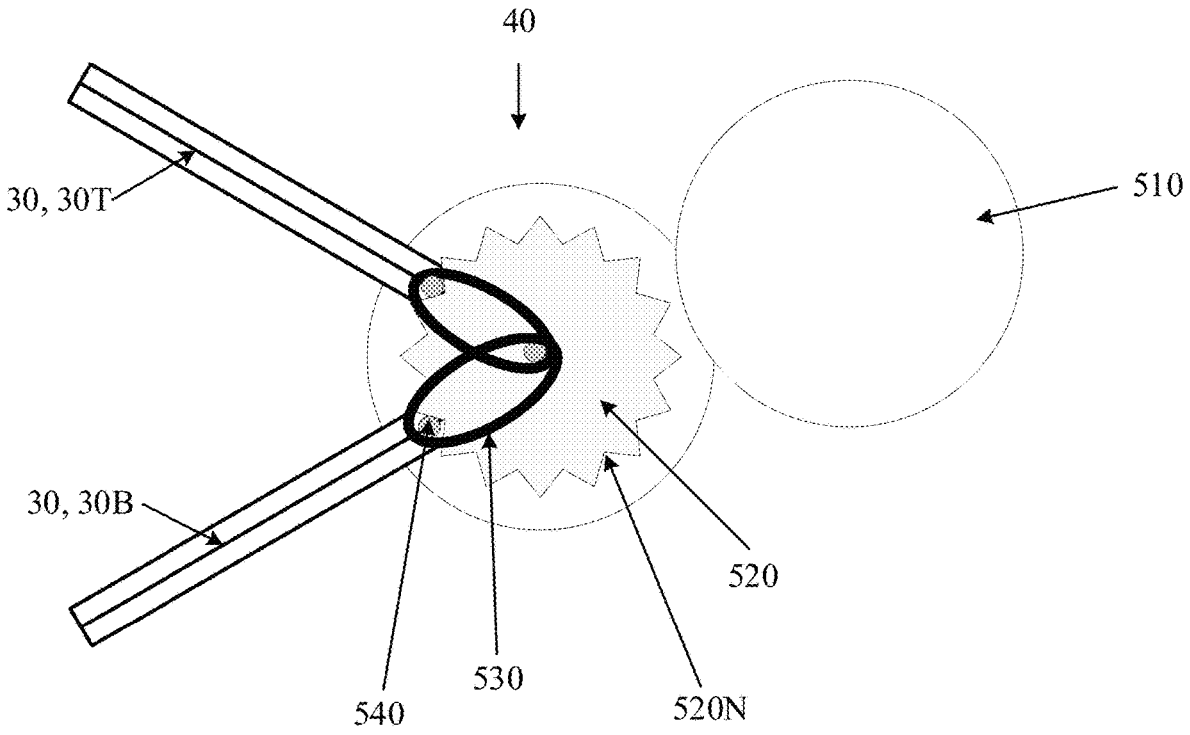
FIG. 5C is a side exploded view of a hinge with ribs attached, all arranged according to at least some embodiments described herein.

FIG. 5A is a side perspective view of a hinge with ribs in an extended position, FIG. 5B is a top perspective view of a hinge with ribs in a contracted position, and FIG. 5C is a side exploded view of a hinge with ribs attached, each arranged in accordance with at least some embodiments described herein. Those components in FIGS. 5A-5C that are labeled identically to components of FIGS. 1-4 will not be described again for the purposes of brevity.

Hinges 40 may be configured to position and secure ribs 30 at multiple positions and configurations along a circumference of hinges 40. FIG. 5A shows an example of positions that base rib 30B, intermediary ribs 301, and top rib 30T may positioned at and secured by hinge 40. Top rib 30T may be positioned at a topmost position of hinge 40 with base rib positioned at the lowest position of hinge 40 with intermittent ribs 301 spaced between top rib 30T and base rib 30B.

FIG. 5B shows an example of ribs 30 positioned in a contracted position by hinge 40. When base rib 30*b*, intermediary ribs 301, and top rib 30T are positioned in a contracted position, each rib 30 may be aligned with each other rib and in contact with each other. Hinges 40 may be configured to lock a position of each rib 30 and may generate a clicking sound and/or a tactile vibration when a rib 30 is positioned and locked.

FIG. 5C depicts a side exploded view of a hinge with ribs attached. Hinge 40 may include a hinge cover 510, a positioning component 520, and a locking component 530. Positioning component 520 may include notches 520N. A rod 540 at an end of each rib 30 may align and be positioned within a notch 520N to position each rib 30 along a circumference of hinge 40. Locking component 530 maybe flexible and may secure rod 540 within notch 520N to lock rib 30 at a position along the circumference of hinge 40. Locking component 530 may generate a clicking sound and/or a tactile vibration when rod 540 is secured within notch 520N and rib 30 is positioned and locked.

A device in accordance with the present disclosure may provide a user with a mask to limit exposure to pathogens. A device in accordance with the present disclosure may provide a user with a mask to limit exposure to pathogens that reduces the risk of hypoxia. A device in accordance with the present disclosure may provide a user with a mask to limit exposure to pathogens that reduces the risk of mask fatigue. A device in accordance with the present disclosure may provide a user mask to limit exposure to pathogens without having the discomfort of straps pulling behind the user's ears. A device in accordance with the present disclosure may provide a user with a mask to limit exposure to pathogens without causing eyeglasses to fog as the exhaled air will travel downward instead of upward.

A device in accordance with the present disclosure may provide a user with a mask to limit exposure to pathogens that can be stored around the neck when not needed and expanded to cover the face when needed. A device in accordance with the present disclosure may provide a user with a mask to limit exposure to pathogens which can be expanded over the face by only touching the outside of the apparatus. A device in accordance with the present disclosure may provide a user with a mask to limit exposure to pathogens that does not impair the speech of the wearer due to a looser fit around a wearer's mouth and neck.

It should be understood that the foregoing description is only illustrative of the present disclosure. Various alternatives and modifications can be devised by those skilled in the art without departing from the disclosure. Accordingly, the present disclosure is intended to embrace all such alternatives, modifications, and variances. The embodiments described with reference to the attached drawing figures are presented only to demonstrate certain examples of the disclosure. Other elements, steps, methods, and techniques that are insubstantially different from those described above and/or in the appended claims are also intended to be within the scope of the disclosure.

What is claimed is:

1. An apparatus to limit exposure to pathogens, the apparatus comprising:

two hinges connected by a hinge connector;

a plurality of ribs; and mask material; and wherein the plurality of ribs includes at least a base rib and a top rib, a first end of each rib is connected to a first hinge of the two hinges and a second end of each rib is connected to a second hinge of the two hinges, the two hinges are configured to position and secure the top rib at multiple positions and configurations, the ribs are attached to the mask material, the base rib is configured to rest upon a chest of a user and provide a base support to the apparatus, and the top rib is configured to conform to a nose and face of a user when the top rib is positioned upon the nose and face of the user.

2. The apparatus of claim 1, wherein the multiple positions and configurations of the hinges are configured to position and secure the ribs at include expanded positions with a center of each rib positioned away from a center of each other rib and a contracted position with centers of the ribs aligned and in contact with each other.

3. The apparatus of claim 1, wherein the hinges are further configured with a locking component to lock the ribs in the multiple positions and configurations.

4. The apparatus of claim 3, wherein the hinges are further configured to generate a clicking sound when a rib is locked in a position.

5. The apparatus of claim 3, wherein the hinges are further configured to generate a tactile vibration when a rib is locked in a position.

6. The apparatus of claim 1, wherein mask material includes at least one of tightly woven fabrics, cotton, cotton blends, synthetic fabrics, breathable fabrics, filter material, HEPA filter material, and N95 filters.

7. The apparatus of claim 1, wherein the plurality of ribs further includes at least one intermediary rib between the base rib and the top rib.

8. The apparatus of claim 7, wherein the at least one intermediary rib is configured to provide support to the mask material.

9. The apparatus of claim 1, wherein the plurality of ribs is constructed from wood, plastic, bamboo, or metal.

10. An apparatus to limit exposure to pathogens, the apparatus comprising:

two hinges connected by a hinge connector;

a base rib, wherein a first end of the base rib is connected to a first hinge of the two hinges and a second end of the base rib is connected to a second hinge of the two hinges and the base rib is configured to rest upon a chest of a user and provide a base support to the apparatus;

a top rib, wherein a first end of the top rib is connected to the first hinge of the two hinges and a second end of the top rib is connected to the second hinge of the two hinges and the top rib is configured to conform to a nose and face of a user when the top rib is positioned upon the nose and face of the user;

an intermediary rib, wherein a first end of the intermediary rib is connected to the first hinge of the two hinges and a second end of the intermediary rib is connected to the second hinge of the two hinges; and mask material; and wherein, the two hinges are configured to position and secure the top rib and intermediary rib at multiple positions and configurations, and the top rib and base rib are attached to the mask material.

11. The apparatus of claim 10, wherein the multiple positions and configurations the hinges are configured to position and secure the top rib and intermediary rib at include expanded positions with a center of each of the top rib, base rib, and intermediary rib positioned away from each other and a contracted position with centers of each of the top rib, base rib, and intermediary rib aligned and in contact with each other.

12. The apparatus of claim 10, wherein the hinges are further configured to lock the top rib and intermediary rib in the multiple positions and configurations.

13. The apparatus of claim 12, wherein the hinges are configured to generate a clicking sound when any of the top rib and intermediary rib is locked in a position.

14. The apparatus of claim 13, wherein the hinges are configured to generate a tactile vibration when any of the top rib and intermediary rib is locked in a position.

15. The apparatus of claim 10, wherein mask material includes at least one of tightly woven fabrics, cotton, cotton blends, synthetic fabrics, breathable fabrics, filter material, HEPA filter material, and N95 filters.

16. An apparatus to limit exposure to pathogens, the apparatus comprising:

two hinges connected by a hinge connector;

a base rib, wherein the base rib is configured to rest upon a chest of a user and provide a base support to the apparatus and a first end of the base rib is connected to a first hinge of the two hinges and a second end of the base rib is connected to a second hinge of the two hinges, a top rib, wherein the top rib is configured to conform to a nose and face of the user when the top rib is positioned upon the nose and face of the user and a first end of the top rib is connected to the first hinge of the two hinges and a second end of the top rib is connected to the second hinge of the two hinges;

an intermediary rib, wherein the intermediary rib is between the base rib and the top rib and a first end of the intermediary rib is connected to the first hinge of the two hinges and a second end of the intermediary rib is connected to the second hinge of the two hinges; and mask material, wherein the mask material includes at least one of tightly woven fabrics, cotton, cotton blends, synthetic fabrics, breathable fabrics, filter material, HEPA filter material, and N95 filters; and wherein, the two hinges are configured to position, secure, and lock the top rib and intermediary rib at multiple positions and configurations, the hinges generate a clicking sound and a tactile vibration when any of the top rib and intermediary rib is locked in a position, and the top rib and base rib are attached to the mask material.

* * * * *